United States Patent [19]

Taylor

[11] Patent Number: 4,824,151

[45] Date of Patent: Apr. 25, 1989

[54] DOOR LOCK

[75] Inventor: Andrew M. Taylor, New Milton, United Kingdom

[73] Assignee: Taylor Lock Company Ltd., Dorset, United Kingdom

[21] Appl. No.: 932,347

[22] Filed: Nov. 19, 1986

[30] Foreign Application Priority Data

Nov. 19, 1985 [GB] United Kingdom ..... 8528445

[51] Int. Cl.[4] ..... F05C 3/06

[52] U.S. Cl. ..... 292/201; 292/74; 292/153; 292/341.16; 292/198

[58] Field of Search ..... 292/DIG. 40, 153, 198, 292/169.15, 169.14, 302, 74, 201, 341.15, 216, 341.16; 70/279

[56] References Cited

U.S. PATENT DOCUMENTS

| | | | |
|---|---|---|---|
| 1,970,653 | 8/1934 | Hendrix | 292/74 |
| 2,183,672 | 12/1939 | Devereaux | 292/302 |
| 2,274,362 | 2/1942 | Devereaux | 292/DIG. 40 |
| 2,428,063 | 9/1947 | Bleyle | 292/302 |
| 2,586,900 | 2/1952 | Alderman | 292/74 |
| 3,260,813 | 7/1966 | Dargene | 292/198 |
| 3,504,511 | 4/1970 | Allen | 70/279 |
| 3,667,792 | 6/1972 | Torii | 292/216 |
| 3,719,380 | 3/1973 | Watermann | 292/216 |
| 3,751,949 | 8/1973 | Castle | 292/169.14 |
| 3,768,847 | 10/1973 | Buck, Jr. et al. | 292/302 |
| 4,097,078 | 6/1978 | Tack | 292/198 |
| 4,165,112 | 8/1977 | Kleefeldt | 292/DIG. 40 |
| 4,258,945 | 3/1981 | Pouget | 292/201 |
| 4,470,625 | 9/1984 | Walsh et al. | 292/201 |
| 4,529,234 | 7/1985 | Senften | 292/169.15 |
| 4,613,176 | 9/1986 | Kelly | 292/201 |
| 4,624,491 | 11/1986 | Vincent | 70/279 |

FOREIGN PATENT DOCUMENTS

| | | | |
|---|---|---|---|
| 340729 | 10/1951 | Switzerland | 292/153 |
| 861465 | 2/1961 | United Kingdom . | |
| 1141585 | 1/1969 | United Kingdom . | |
| 1411469 | 10/1975 | United Kingdom . | |
| 1528401 | 10/1978 | United Kingdom . | |

*Primary Examiner*—Gary L. Smith
*Assistant Examiner*—Eric K. Nicholson
*Attorney, Agent, or Firm*—Cushman, Darby & Cushman

[57] ABSTRACT

A door lock comprising a block having a slot into which a locking arm moves when the door is shut. A pivot arm is resiliently biassed to extend into the slot and, a separate locking element is resiliently biassed to slidably extend into the slot. While a rotatable element is resiliently biassed to rotate clockwise to bring a roller directly under the locking element, the pivot arm abuts the roller and is itself resiliently biassed to prevent the roller from reaching a position fully under the locking element. Entry of the locking arm into the slot depresses the pivot arm forcing the locking element downward to permit full entry of the locking arm into the slot. As the locking element descends, the roller is urged counter-clockwise and the locking element engages a channel in the locking arm. The depressed pivot arm will not abut the roller at this point thereby allowing it to reach a position fully under the locking element which locks the locking element in the locking arm channel. An opening mechanism rotates the rotatable element counter-clockwise releasing the locking element and the locking arm from the slot.

14 Claims, 6 Drawing Sheets

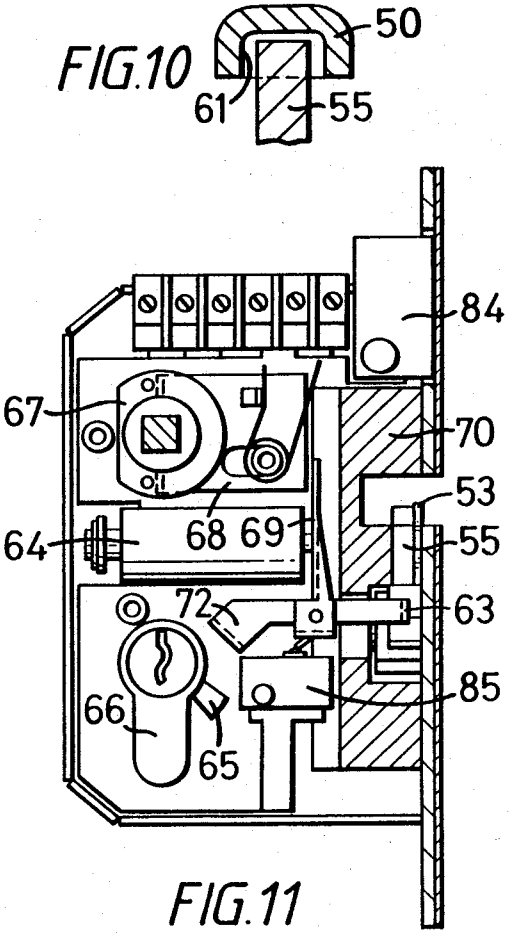
FIG.10
FIG.11
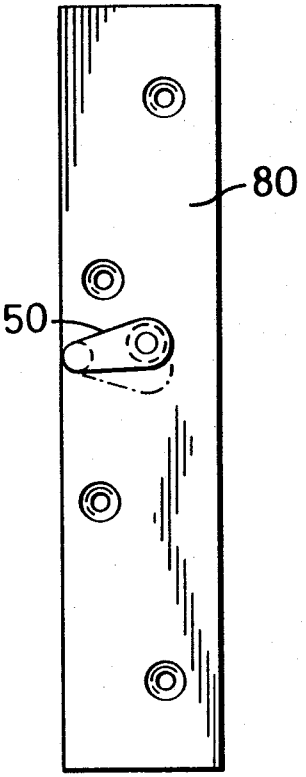
FIG.9(c)
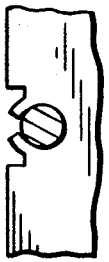
FIG.9(b)
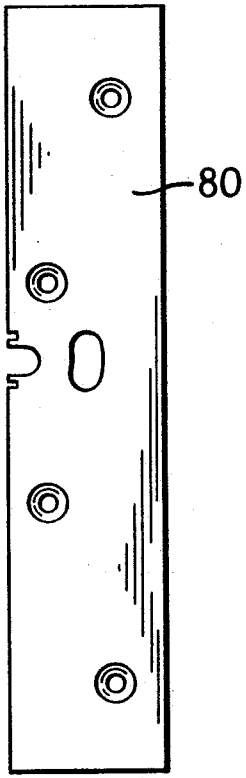
FIG.9(a)

DOOR LOCK

BACKGROUND OF THE INVENTION

This invention relates to door locks, and in particular to door locks suitable for both mechanical and electrical operation.

DESCRIPTION OF THE PRIOR ART

A known door lock comprises a bolt located in a lock-case affixed to a door, which bolt moves across to engage with a locking plate or staple secured to the door frame.

One of the main criteria for such door locks is that they are strong to prevent forced opening yet comprise a single lock in a compact form. Furthermore, it is important that the lock is difficult to open illegally by means of tampering. To enable electrical operation of the door lock, it is necessary to produce sufficient force to move the lock bolt to extend into the door frame, the force required is quite large. As a result, undesirably large solenoids must be employed, which require relatively large amounts of electrical power, produce considerable noise when activated and increase the overall size of the door lock. One of the reasons for the large power requirement is that if a slight opening pressure exists between the door and the door frame, for example because of the weight of the door, then the substantial friction or misalignment between the bolt and the locking plate may need to be overcome by force. Indeed, with prior art door locks it has been found that the slightest opening pressure can prevent such electrically operated locks from opening at all. Thus electrically operated locks are expensive to produce which has limited their use.

It is also preferable for a door lock to act as a dead lock yet be capable of being pushed closed. However, with prior art door locks, it is necessary to have an angled face on the bolt so that when the door is pushed closed, the interation between the locking plate and angled face forces the bolt into the lock-case as the door is closed. Unfortunately, such locks are subject to illegal tampering by means of a probe. In addition, one of the problems associated with these door locks is the wear on the lock resulting from friction during opening and closing of the door lock. In circumstances where a door lock is operated frequently, for example up to 1,000 times every day, known locks require replacement after approximately 50 to 60 days. Although it would be possible to produce a lock having lower wear by means of employing special materials, the resulting cost increase of the lock is prohibitive.

SUMMARY OF THE PRESENT INVENTION

It is therefore an object of the present invention to provide an economical door lock, particularly suitable for electrical actuation, having high resistance to forcible attack, requiring little actuating force even though considerable opening force is applied to the door, and having reduced friction during opening and closing.

It is also an object of the invention to provide a door lock without a bolt passing between the door and frame, and having a low electrical requirement for electrical operation and which is relatively silent in operation.

It is also an object of the invention to provide a relatively inexpensive door lock which can provide an automatic dead lock.

According to one aspect of invention there is provided a door lock for a door comprising a door frame mounting having a locking arm of predetermined form extending outwardly from the door frame in use; and a lock apparatus for mounting to the door, the lock apparatus having operating means defining an aperture which the arm must enter when the door is closed, the operating means being movable by the locking arm as the arm enters the aperture so that the arm can fully enter the aperture and being urged to constrict the aperture to prevent withdrawal of the arm therefrom once the arm has entered the aperture; and unlocking means capable of moving said operating means to a position to allow withdrawal of the locking arm from the aperture.

In this way, the door lock provides an automatic dead lock since the locking arm is imprisoned within the aperture when it enters therein. At the same time, little force is required for the locking arm to enter the aperture, but once therein the operating means in combination with the locking arm interact to imprison the locking arm frimly therein. As a result, there is little friction involved so that wear of the lock mechanism is substantially reduced compared with the prior art. Furthermore, it has been found with such a door lock that when slight opening pressure is applied to the door, the unlocking means can still easily actuate the operating means to release the locking arm when compared with prior art door locks. Finally, such a door lock is relatively simple and compact compared with the known door locks so that a more compact and cheaper doorlock can be produced.

In a prefered embodiment of the invention, the locking arm is connected to the door frame mounting in a manner to permit alteration of the locking arm position on the door frame. Conveniently, the locking arm is pivotally connected to the door frame mounting. Since the present invention has a locking arm fixed to the door frame to enter an aperture of a lock apparatus in the door, it is relatively simpler to alter the relative position of the locking arm because with prior art door locks, the lock bolt is located in the lock apparatus. Consequently, the present invention makes it much easier to adjust for misalignment between the door frame and the door caused by warping, dropping or swelling or the like. Such effects would in the prior art impede entry of the lock bolt into the locking plate. It will be apparent that such difficulties are particularly relevant when the door lock is electrically operated and the resistance to operation of the bolt is in excess of the electrical force obtainable. The withdrawal of the locking arm from the aperture is relatively simple and accordingly, the door lock is particularly suitable for electrical operation. As a result, the required electrical force for opening the lock is much smaller than hitherto known door locks.

In a preferred embodiment of the invention the lcoking arm includes a roller located at the end remote from the door frame mounting and the operating means comprises cam means defining the aperture and which obstruct entry of the roller into the aperture but are movable by the roller on closing of the door to allow entry of the roller into the aperture, the cam means being urged to constrict the aperture to prevent withdrawal of the roller therefrom. By employing a locking arm having a roller and cam means for imprisoning the roller in the aperture, friction on locking and hence wear of the lock is substantially reduced compared with hitherto known locks. Furthermore, the action of the cam means preventing withdrawal of the locking arm from the aperture so as to produce an automatic dead lock. In addition, when the unlocking means moves the cam means to a position to allow withdrawal of the roller, the action of the cam means and roller results in low friction and hence reduced wear resulting from removal of the locking arm from the aperture and also the force required to move the cam means is quite small. Thus, the reduced friction, wear and unlocking force lends itself to electrical operation. The embodiment can accordingly be designed to be compact.

Preferably the locking arm is pivotably connected to the door frame moounting and the cam means comprises a pair of spaced apart cams resiliently biased to define the aperture, the roller acting on one of the cams to rotate the cam to a position permitting entry of the roller into the aperture, and the unlocking means acting on the other cam to move it to a position permitting withdrawal of the roller from the aperture.

In an alternative embodiment of the invention the locking arm is pivotally connected to the door frame mounting and the cam means comprises a fixed cam roller spaced apart from a shaped cam roller to define said aperture, the locking arm roller acting on the shaped cam to rotate the shaped cam to a position permitting entry of the locking arm roller into the aperture, the shaped roller being resiliently biased to rotate to a position whereby the shape of the cam prevents withdrawal of the locking arm roller from the aperture, and the unlocking means being connected to rotate the shaped roller to a position allowing withdrawal of the roller from the aperture.

In an another alternative embodiment of the invention the operating means has a recess and a slidable locking element is resiliently biased into the recess to define said aperture, the operating means including rotatable cam element resiliently biased to a first position locking the locking element to extend into the recess for preventing withdrawal of the locking arm and a second position allowing sliding of the locking element to a position to allow entry of the locking arm into the aperture, and a pivotable lever arm located to extend into the recess to hold the cam element in said second position and being pivotted by the locking arm entering said aperture to a position and being held in that position whereby the cam element can move to the first position, the unlocking means being connected for moving the cam element to said second position.

The advantage of this embodiment is that when the locking arm is located in the recess, the locking arm can only be removed by actuation of the unlocking means. In addition, although the locking element may be accessable to a probe inserted through the recess, since the locking slide is prevented from movement by the cam element which can be contained in the lock apparatus interior, the door is resistant to tampering. Furthermore, the combination of the pivot lever, cam element and locking element produces a door lock which can be closed with light pressure, positively and quitely without use of a key or handle and an automatic dead lock is produced. Conveniently, the locking arm comprises a solid element having a groove formed therein such that the locking element locates in said groove in said first position on complete entry of the locking arm into the aperture.

The unlocking means can comprise of a solenoid located for moving said operating means to allow withdrawal of the locking arm from the aperture when the solenoid is actuated, a pivotable door handle having a pivot arm located for moving said operating means to allow withdrawal of the locking arm from the aperture, or a key cylinder movable by the correct key to a position for moving said operating means to allow withdrawal of the locking arm from the aperture.

BRIEF DESCRIPTION OF THE DRAWINGS

Examples of the present invention will now be described with reference to the accompanying drawings, in which:

FIG. 9 illustrates a locking arm for use with the embodiment shown in FIG. 7, FIG. 10 illustrates a section along the lines A—A shown in FIG. 7(*d*), FIG. 11 illustrates the unlocking mechanism for the embodiment shown in FIG. 7 including micro-switches for indicating the current status of the opening mechanism.

DETAILED DESCRIPTION OF THE PREFERRED EMBODIMENTS

Figure 1:
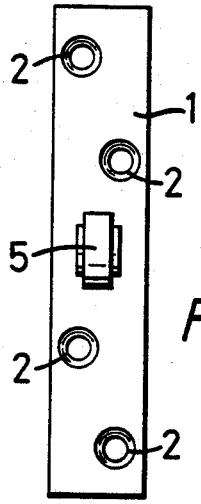
FIG. 1 illustrates the frontal view of the locking arm.
Figure 2:
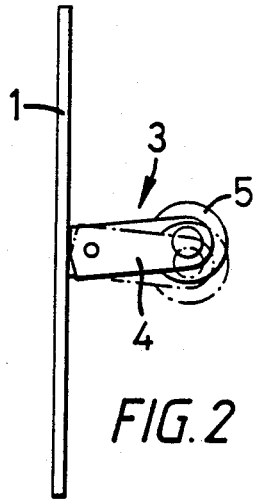
FIG. 2 illustrate a side view of the locking arm shown in FIG. 1.

Refering to FIGS. 1 to 3, wherein common components carry the same reference numerals, a plate member 1 is fixed in use to a door stop or door frame by means of screws passing through apertures 2 formed in the plate member. As seen in particular in FIG. 2, a locking arm 3 is connected to the plate member 1. The locking arm comprises a pair of side by side flanges 4 which are pivotally connected at one end of the plate member 1 and carry at the other end thereof a rotatable roller 5.

A lock apparatus generally identified by the numeral 6 is located on or in a door closing the space defined by the frame to which the plate member 1 has been fixed. It will be apparent that the present invention relates to a door lock arranged for fitting to a member having movement in relation to a rigid member so that in the closed position the moving member can only be opened as the result of operation of a key or handle or the lock mechanism. The moving member may be closed and held against movement by the lock without use of a key or handle, or the lock may be of the type wherein the door lock is moved to the locked position by the operation of a key or handle from one or both sides of the moving member. The lock may also be of the type fitted to the surface of the moving member from which it projects or it may be of the type morticed into the front edge thickness. A key mechanism may be incorporated in the door lock or it may be fitted as a separate unit operatively connected to the door lock.

A locking apparatus of the door lock is located in the front edge of the door with an edge plate 9 flush with the front edge of the door. The edge plate 9 includes a hole 14 through which the locking arm 3 can pass when the door is closed on to the door frame on which the plate member 1 is fixed. In the example illustrated, the plate member 1 is fixed to the door stop of the door frame. The locking apparatus 6 comprises an upper cam roller 8 spaced from a lower cam roller 7 by a distance d to define an aperture which is smaller than the diameter of the roller 5. The lower roller 7 has a segment 13 of its circumference cut away to extend substantially 180° around the circumference of the roller 7, as illustrated in FIG. 3. In this way, the axis of rotation of the roller 7 can be located close to the edge plate 9. The roller 7 also includes an inwardly facing radial cut 10 spaced from the removed section of the roller 7 so that a small radial flange 11 is formed on the roller 7. The upper roller 8 includes a radial cut 12 similar to the cut 10 but facing outwards from the door, and also has a cut away portion 13' facing outwards to also allow the axis of the roller 8 to be located close to the plate 9.

As shown in FIG. 3(*b*) when the locking arm 3 enters the hole 14, the roller 5 contacts and acts against the radial flange 11 which cannot rotate anti-clockwise because a lever arm 15, located at the lower end of the radial cut 10, is prevented from rotation because of the immediate proximity of a pin 17 of a solenoid 16. Thus, the locking arm 3 pivots upwards slightly and engages with the radial cut 12 on the roller 8 and thereby rotates the roller 8 in a clockwise direction. After the roller 5 passes between the rollers 7 and 8, the roller 5 disengages the radial cut 12 and the roller 8 is urged back to its original position by means of a spring 18. As a result, the gap between the upper and lower rollers 7 and 8 returns to the distance d which is smaller than the diameter of the roller 5. Since the roller 8 has its surface 13' right against the plate 9, this prevents this clockwise rotation of the roller 8. The radial flange 11 on the roller 7 is formed so that when attempts are made to withdraw the locking arm from the locking apparatus, the roller 5 acts on the flange 11 to rotate the roller 7 in a clockwise direction, as shown in FIG. 3(*c*). However, the roller 7 is prevented from clockwise rotation by the abutment of segment 13 with plate 9.

In order to release the locking arm from the lock apparatus, an unlocking means is provided which has the solenoid 16 and solenoid pin 17. When the solenoid is electrically actuated, the pin 17 acts on the lever 15 to push the lever 15 upwards to rotate the roller 7 clockwise so that the radial flange 11 no longer interacts with the roller 5 but instead the radial cut 10 engages with the roller 5 so that withdrawal of the locking arm 3 produces further clockwise rotation of the roller 7 and the locking arm 3 pivots downwards slightly to allow roller 5 to escape from between rollers 7 and 8 as shown in FIG. 3(*e*). The roller 7 includes a spring 25 to urge the roller anti-clockwise to return it to the position shown in FIG. 3(*a*) after the locking arms has been withdrawn.

Figure 4:
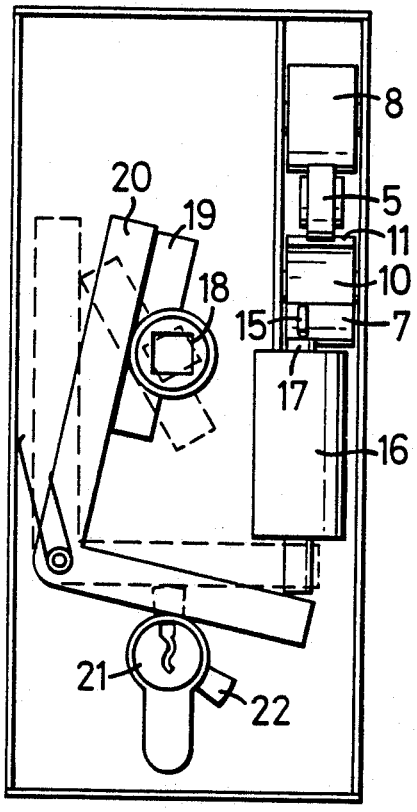
FIG. 4 illustrates the operation of the unlocking mechanism of the embodiment shown in FIG. 3, FIGS. 5(*a*) to (*e*) illustrate the operation of another embodiment of the present invention.

FIG. 4 illustrates an the unlocking mechanism of the door lock apparatus shown in FIG. 1 to 3 and in particular illustrates an unlocking mechanism as viewed along the arrow X shown in FIG. 3(*c*). It will be apparent that in this example, the locking arm 5 is mounted to extend from the door stop rather than the frame face opposite the side of the door. In this example, when a handle is inserted through aperture 18 and rotated a follower 19 shown in solid line acts against an operating lever 20 shown in solid line so that both rotate to the positions shown in dotted lines. It can be seen that in the position shown by dotted lines, the lever arm 20 acts on the lower end of the pin 17 of the solenoid 16 to force it upwards to contact the lever arm 15 in the manner shown in FIG. 3(*d*) so that the locking arm can be withdrawn and the door opened. Similarly, when a correct key is located in cylinder 21, it is possible to rotate the cylinder so that a cam 22 thereon is rotated to a position shown in dotted line wherein it also acts against the lever arm 20 to push it into the position shown in dotted line where it acts against the lower end of the pin 17 again to allow withdrawal of the locking arm from the hole 14. A spring can be employed to return the operating lever 20 to the position shown in solid lines. Of course, electrical energy can be provided to the solenoid 16 to move the pin 17 to the position shown in FIG. 3(*d*).

Therefore, with a pair of spaced apart cam rollers having radial cuts as described herein, it is possible to produce a door lock wherein the friction of locking and unlocking is substantially reduced compared with hitherto known door locks. At the same time, the door lock mechanism can be adapted to be locked and unlocked by means of either a key, a handle or solenoid operation. It will be apparent that the cooperation of the rollers 7 and 8 together with the pivotable locking arm 3 produce in effect self alignment to compensate for any changes in the relative position between the door and the door frame caused by, for example, warping of the door or dropping of the door. The aformentioned lock is capable of operation even when a predetermined pressure is applied to the lock, and because roller 3 and cam rollers 7 and 8 interact in a low friction and low force manner, it is possible to produce a relatively silent operating lock capable of fitting to the inside surface of the door from which it projects or is morticed into the front edge thickness of the door. Finally, the components making up the door lock described and the assembly thereof is more economical than hitherto known door locks.

Figure 6:
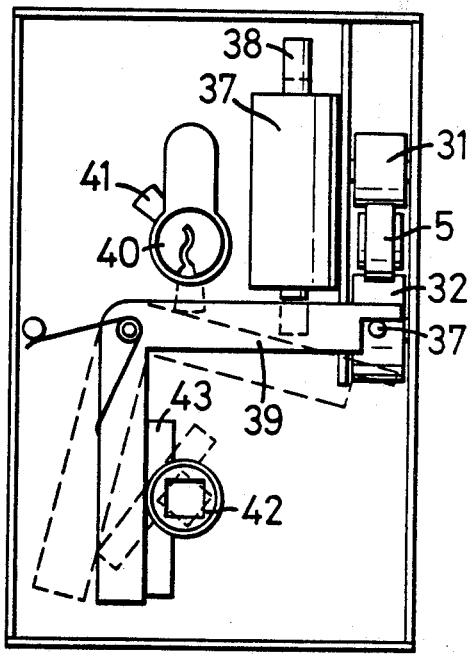
FIG. 6 illustrates an unlocking mechanism for the embodiment shown in FIG. 5, FIG. 7(*a*) to (*d*) illustrates a still further embodiment of the present invention, FIG. 8(*a*) and (*b*) illustrate unlocking mechanism for the embodiment shown in FIG. 7.
Figure 3A:
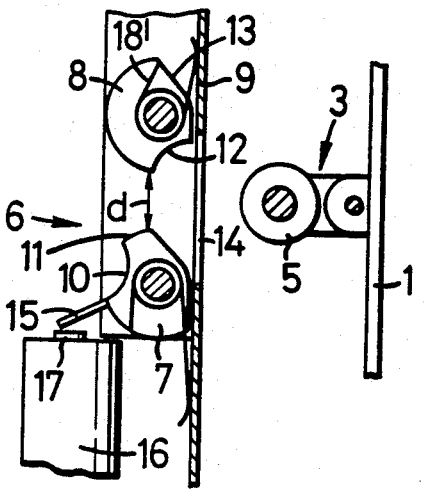
FIGS. 3(*a*) to (*e*) illustrates the operation of one embodiment of the present invention.
Figure 3B:
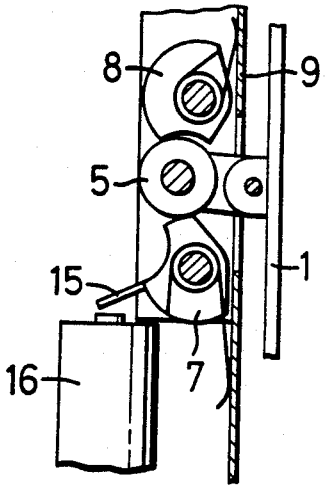
Figure 3C:
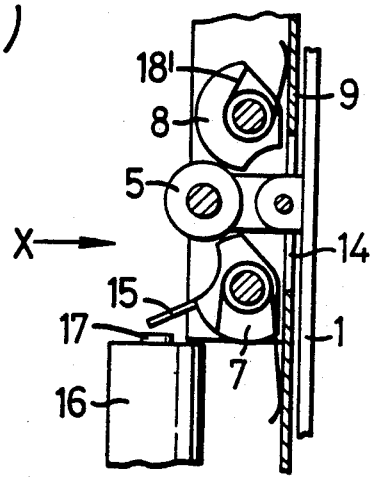
Figure 3D:
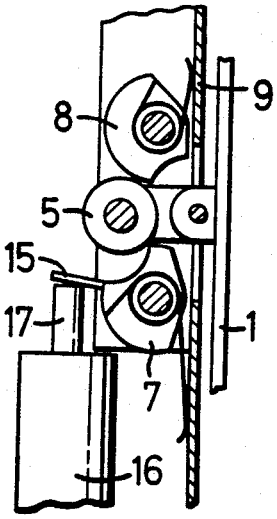
Figure 3E:
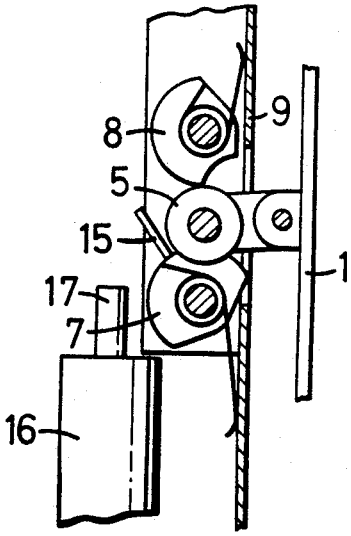
Figure 5A:
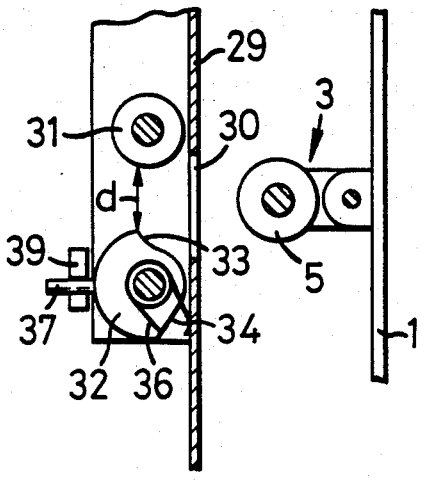
Figure 5B:
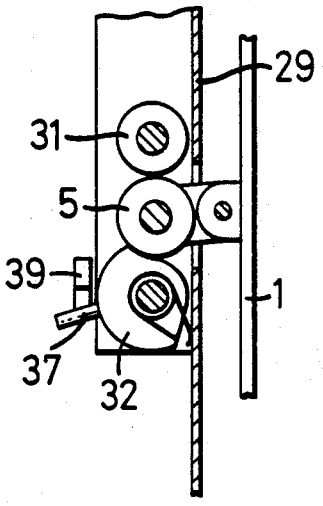
Figure 5C:
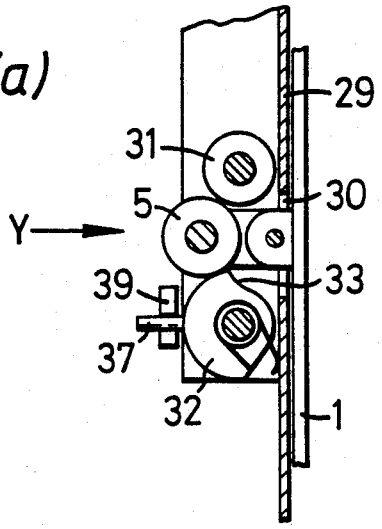
Figure 5D:
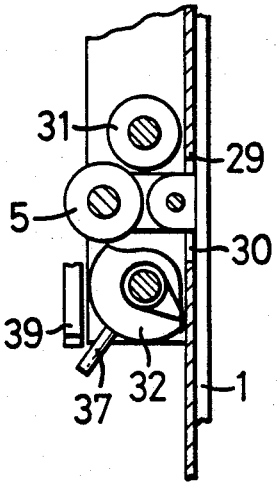
Figure 5E:
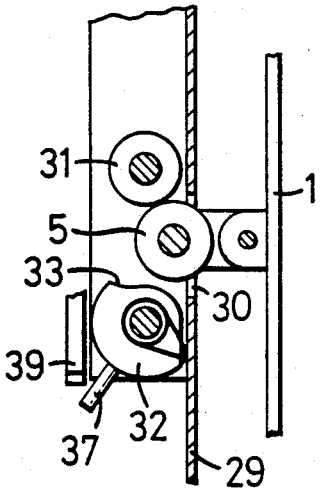

Refering now to FIG. 5 and 6, the locking arm 3 has the same form as shown in FIG. 1 and 2. In the examples shown in FIGS. 5 and 6, a side plate 29 of the lock apparatus includes a hole or slot 30 into which the locking arm 3 is inserted to close and lock a door. An upper roller 31 is provided on a fixed axis and having a complete circumference. A lower cam roller 32 is provided, spaced from the upper roller by a distance d to define an aperture. The roller 32 has the surface facing the locking arm 3 cut away to provide cut away portion 33 in the upper part and a flat 34 in the lower part. As the locking arm is inserted through the hole 30 the roller 5 encounters the cut 33 and engages therewith to cause the roller 32 to rotate in an anti-clockwise direction as the arm is further inserted. Slight downward pivoting of the arm 5 is necessary to clear roller 31. As a result, the aperture between the upper and lower rollers 31 and 32 increases to permit passage of the roller 5 therethrough. A spring 35 is provided to return the cam roller 32 to its original position after the roller 5 has passed. It is now not possible to remove the locking arm 3 from between the rollers 31 and 32 because the upper roller 31 is fixed and the lower roller 35 is prevented from clockwise rotation by a plate 36 of the casing of the lock engaging the cam roller surface adjacent the flat 34. Accordingly, the locking arm is locked in the lock apparatus.

In order to release the locking arm from the lock apparatus, a lever arm 37 is attached on the inward side of the roller 32 and moved downwards to rotate the roller 32 anti-clockwise until the flat 34 encounters the plate 29. In this position, the cut 33 is presented to the roller 5 so that in effect the aperture between the upper and lower is temporarily increased to permit passage of the roller 5 therethrough as shown in FIG. 5(*d*) and (*e*).

Refering to FIG. 6 which illustrates a view along the arrow Y shown in FIG. 5(*c*) a solenoid 37 having a pin 38 is located in a position so that on actuation of the solenoid, the pin 38 acts on a lever arm 39 to move it from its position shown in solid line to its position shown in dotted profile. The end of the lever arm 39 is cut away so as to be above the arm 37. As a result, when the lever arm 39 moves from the solid line position to the dotted line position, the lever arm 37 is moved downwards to produce the opening effect shown in FIG. 5(*d*) and (*e*). The apparatus also includes a cylinder 40, having a follower 41 which is rotated when the correct key is located in the cylinder 40. The follower 41 is rotated to the position shown in dotted profile in the figure and acts on lever arm 39 to produce the aformentioned opening effect. Similarily, when a handle is located in aperture 42 and rotated an associated cam 43, shown in solid profile adjacent to the solid profile of lever arm 39, is rotated to its position shown in dotted profile which moves the lever arm 39 to the position shown in dashed profile so that the aformentioned opening effect occurs.

It will be apparent to a person skilled in the art that the handle provided can be of the type to turn or to press or to pull while the associated lever is adapted to suit. Also, instead of an electrically operated solenoid, the lever arms of the unlocking mechanism can be associated with an electric motor to cause movement of the required cam roller or may be connected by pneumatic or hydraulic connection to the lever or by direct contact with the other roller. In all forms of the invention, the upper and lower rollers and also the roller on the locking arm may be equipped with ball or roller bearings to reduce operational friction. The lever is preferably of bell crank form in which the ratio in length of the arms is as high as possible, again to mimi-nise friction.

Figure 7A:
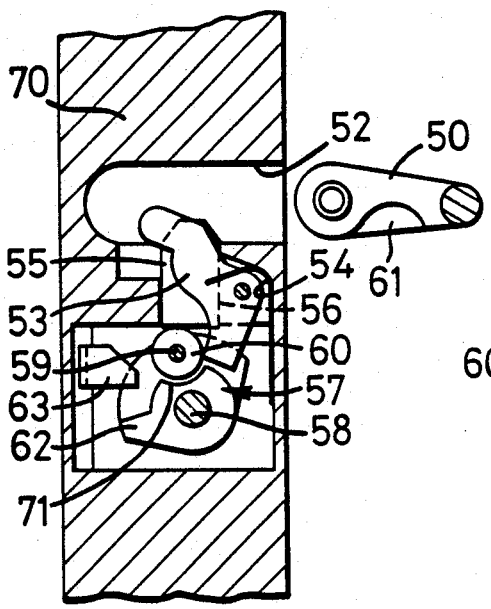
Figure 7B:
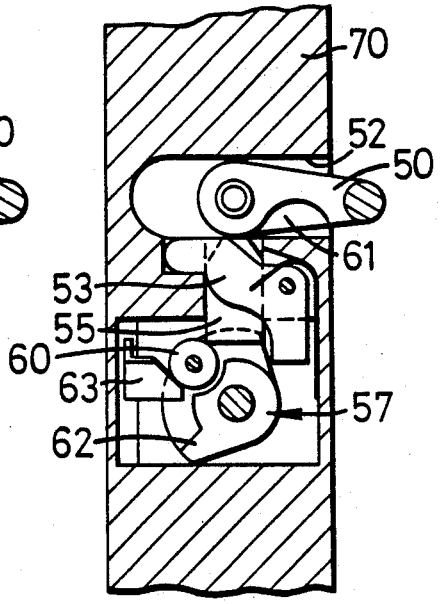
Figure 7C:
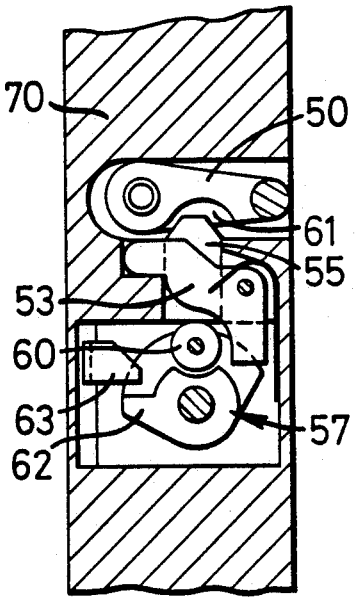
Figure 7D:
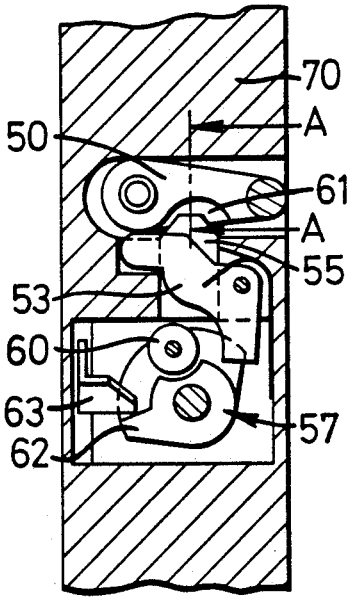
Figure 8A:
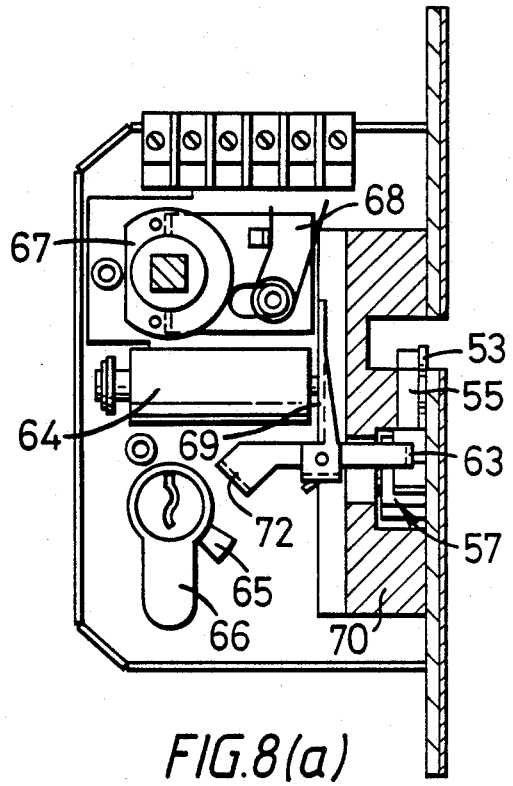
Figure 8B:
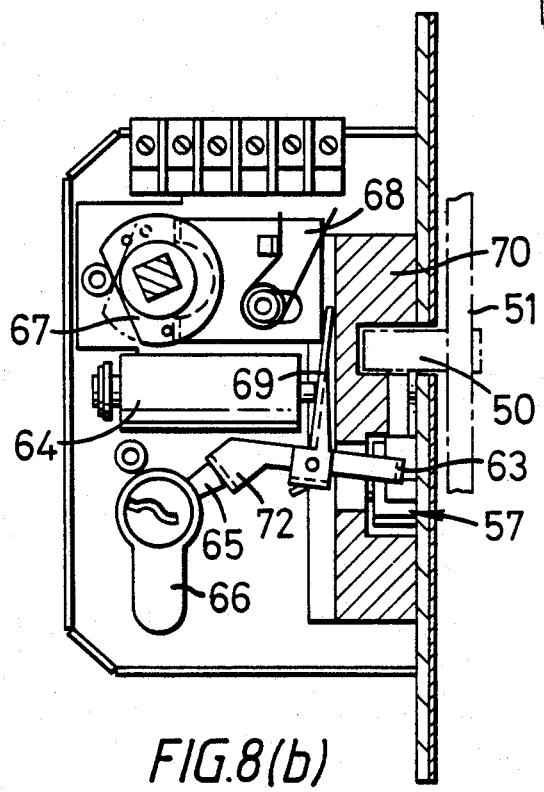

Refering now to FIG. 7 and 8, these figures illustrate a further alternative embodiment of the present invention. In FIG. 7 there is illustrated a side view of a door edge into which a locking apparatus embodying the invention has been located. As can be seen particularly from FIG. 8(*b*) a plate 51 carrying a locking arm 50 is fixed onto the side of a door frame. Thus, the locking arm 50 shown in FIG. 7 is shown with the side plate 51 omitted.

The locking apparatus shown in FIG. 7 comprises a solid block 70 having a slot or recess 52 into which the locking arm 50 moves when the door is shut. A pivot arm 53 extends into the recess 52 and has a spring 54 located to urge the pivot arm 53 into the recess as shown. Immediately adjacent the pivot arm 53 there is provided a locking element 55 which is slideably located in a vertical channel 56. The upper end of the element 55 has an inclined face and the lower surface of the element 55 is flat. The locking element 55 is resiliently biased by a spring (not shown) to extend a predetermined amount into the recess to define an aperture between the upper surface thereof and the upper surface of the recess 52. The aperture is sized to be smaller than the relevant vertical dimension of the locking arm 50 as will be explained hereinafter. Immediately beneath the locking element there is located a rotatable element 57 which is rotatable about a fixed axis 58. The element 57 has an annular surface with a radial cut 71. An axis 59, immediately above the cut, is provided onto which an independently rotatable roller 60 is located. Thus, as the element 57 rotates, so also does the roller 60. The element 57 is urged by spring means (not shown) into a clockwise direction until the roller 60 contacts the lower end of of the pivot lever 53 which is urged to pivot against the roller 60 by the spring 54 which is stronger than the aformentioned spring means for the cam member 57. Thus, the cam roller 60 is prevented from reaching a position fully under the locking element 55.

In operation, as the locking arm 50 enters the slot 52 it interacts almost simultaneously with the upper end of the pivot arm 53 and the upper end of the locking element 55. The pivot member 53 is pushed down into the floor of the slot 52 and pivots in an anti-clockwise direction, the lower end thereof moving to the right as shown in FIG. 7. However, before the spring urged element member 57 can rotate further clockwise to bring the roller 60 under the element 55, the locking element 55 is itself urged downwards as shown in FIG. 7*b* by the locking arm 50 entering the slot 52. The movement of the locking element 55 urges the roller 60 to rotate in an anti-clockwise direction to allow the locking element 55 to fully descend in the channel 56 to allow the front end of the locking arm 50 fully into the slot 52. As can be seen with particular reference to FIG. 10, the locking arm 50 includes a channel 61 which locates above the channel 56 when the locking arm 50 fully enters the slot 52. In this position, because the locking element 55 is resiliently biased toward slot 52, the locking element 55 moves up into engaging contact with the channel 61 of the locking arm. The roller 60 is now free to move further clockwise than before under the action of the spring urging element 57 to rotate clockwise because the pivot arm 53 is still depressed by the front end of the locking arm 50. Thus, the roller 60 rotates to a position fully under the locking element 55 as shown in FIG. 7(*c*). It will be apparent that the roller 60 is a preferred embodiment to reduce friction between the element 57 and the locking element 55. In this position, the roller 60 is firmly located beneath the locking element 55 and completely prevents the element 55 descending in the channel 56. Thus the arm 50 is locked in slot 52.

The element 57 also includes an arm 62 which engages an operating lever 63 which is mounted in the lock apparatus. Refering to FIG. 8, the operating lever 63 is extended by arms 69 and 72 so that it can be moved by either a solenoid 64 acting on arm 69, the action of a cam follower 65 assocaited with a key cylinder 66 acting an arm 72 or by rotation of a handle arrangement 67 which moves a slide 68 across to act against arm 69. Operation of any one of the three aformentioned arrangements causing the release of the locking arm 50 because the operating lever 63 descends as illustrated in FIG. 8(*b*) and acts against the arm 62 to rotate the cam element 57 anti-clockwise. As a result, the roller 60 is moved to a position where it no longer completely obstructs the downward sliding of the locking element 55. Consequently, when the locking arm 50 is withdrawn from the slot 52 it encounters the inclined upper surface of the locking element 55 and urges it downwards. The result is that the roller 60 is pivoted further anti-clockwise back to a position as shown in FIG. 7(*b*)

so that the locking element descends fully after which the locking arm 50 can be fully withdrawn from the slot 52 so that the door is opened. After opening, the operating lever 63 returns to its normal position out of contact with the arm 62 and the pivot lever 53 again extends into the slot 52 thereby preventing the roller 60 returning to its full locking position as shown in FIG. 7(*c*)

The front end of the block 70 corresponding to the edge of the door is concealed by a lower forend which has a slot across part of the width to correspond with the slot 52. When the lower forend is secured to the block 70, the locking element 53 and cam element 57 are concealed so that only the upper end of the locking element 53 can be contacted from this side. The unit comprising the block, locking element, cam element and roller 60, operating lever and lower forend are secured in or to a lock case by screws from the lock case into holes in the block. Of course, rivets or welding may be employed but this prevents access to the door lock without removing the lower forend which cannot be achieved without first removing the block from the lock case. The various other components of the door lock are accessible by removing the screws securing a cover plate to the lock case. Preferable, the lower forend is concealed by a upper forend which is formed with a right angle extension to cover the side face of the block. The upper forend also has a slot across part of the width to correspond with the slot 52 and the slot in the lower forend.

The lock described with reference to FIGS. 7 and 8 is intended for installation in a mortice cut in the opening edge thickness of a door and extending into the width of the style. The lock is secured to the door by screws through the lower and upper forends.

Refering to FIG. 9, the locking arm comprises a plate 80 secured to the frame work or door jam corresponding to the position to the lock. The plate has connected thereto the locking arm 50 in a manner to permit movement on the plate so that adjustment for incorrect alignment between the plate and locking apparatus can be achieved. The size and form of the locking arm is determined by the size of the slot in the block 70, the slot in the lower and upper forends, and also by the projection of the locking element 55 into the slot 52 so as to ensure the necessary alignment of the channel 61 with the locking element 55 when the door is closed. It will be apparent that the plate 80 may be of angled section so that one side may be recessed and secured in the door frame and the other side recessed and secured in the door stop. The locking arm is mounted to the side recessed into the door. This latter mounting has the advantage of concealing the slot in the upper forend on the outside face of the door through which the locking arm passes to the position of engagement in the slot 52 in the lock 70.

It will be apparent that the embodiment described with reference to FIGS. 7 and 8 is particularly advantageous since a probe cannot be inserted through slot 52 in order to move roller 60 when it is in position shown in FIG. 7(*c*). Accordingly, a particularly secure lock is provided. Furthermore, the friction involved in the embodiment shown in FIG. 7 and 8 is much less than compared with hitherto known door locks and indeed it has been found with the present embodiment that a quarter of a million operations can be carried out without significant wear. At the same time, the components of the lock and the assembly thereof allows much cheaper production of the door lock. The lock can also easily be adapted to electrical use. Such an electrical door lock has been found to be much more economical to produce than hitherto know electrical locks, mainly because the solenoid 64 required to operate the lock is of a considerably reduced power compared with prior art solenoid operated locks, for example, the solenoid 64 can operate the door lock illustrated with ½ amp at twelve volts. In addition, the door lock illustrated in FIGS. 7 and 8 provides an automatic dead lock when the locking arm 50 fully enters the slot 52.

Refering to FIG. 11, the embodiment shown in FIGS. 7 and 8 can be conveniently adapted to form part of an electrical system wherein the status of the door to which the lock is fitted can be indicated by lights on an associated panel. It will be apparent that switches 84 and 85 can be provided as illustrated to indicate whether the door is unlocked or locked and whether the door is opened or closed. In all the arrangements of the invention incorporating electrical switches, terminal blocks are incorporated so that all electrical connections may be made to the corresponding positions of the terminal block leaving only the actual connection to the electric system to be made by the installer without the need for removing the lock cover.

It should be understood that the present invention encompasses embodiments other than those illustrated, the construction of which would be readily apparent to a person skilled in the art. For example, the slot shown with respect to FIG. 7 and 8 is shown as being closed at one end. In fact, the slot may extend through the thickness of the block to enable the locking arm to pass right through the slot when the lock is fitted to swing type doors. Of course, the end of the pivot arm 53 would need to be formed to cooperate with the form of the locking arm. The lock as now described is intended for use on single or double and also swing through doors of mortice types fitted within the thickness of the door, or they may be of the rim type fitted to the face of the door from which it would project. Alternatively, part or whole of the lock case may be recessed into the face of the door.

The door locks described herein are particularly intended for assocaition with an electric system in which the door lock is actuated by the output from a control system to provide operation by push button, pull or pivoted handle or other remote control including association with an electric motor from one side of the door and by actuation of the lock by key operation, digital and card key systems fitted directly to or remotely positioned to the lock. The locks are also intended to be used as a manually operated dead lock or automatic locking dead lock capable of operation by knob/handle/push button from one side of the door and by operation of an appropriate key from the other side of the door. Key operation may alternatively be arranged from both sides of the door.

What we claim is

1. A door lock comprising a locking arm mountable to a door frame and a lock apparatus mountable to a door, said lock apparatus comprising means defining a recess suitable for receiving said locking arm, a slidable engaging element, first means for urging said slidable engaging element into an extended position into said recess, an internally located locking element, second means for urging said locking element to move into a locking position locking said slidable engaging element in said extended position, and latch means for moving said locking element into said locking position in response to full entry of said locking arm in the recess whereby in the locked position said slidable engaging element cooperates with the predetermined form of said locking arm to prevent the withdrawal thereof from the recess; and unlocking means capable of moving said locking element from said locking position to unlock said slidable engaging element.

2. A door lock as claimed in claim 1 wherein said the locking element comprises a rotatable cam element movable between locking and unlocking positions with the latter unlocking position allowing sliding of said slidable engaging element to a position allowing entry and exit of said locking arm into and from the recess, respectively, said latch means comprising a pivotable lever arm comprised of a first portion which extends into the recess and a second portion which maintains said rotatable cam element in the unlocking position, said lever arm being pivoted by movement of said locking arm into said recess to a predetermined position and being held in that position wherein said rotatable cam element can move to the locking position, said unlocking means being operatively connected to said rotatable cam element for moving said rotatable cam element to the unlocking position.

3. A door lock as claimed in claim 2 means including a third means for urging said pivotable lever arm into said recess so that said rotatable cam element normally assumes the unlocked position and the strength of said third urging means is greater than the strength of said second urging means.

4. A door lock as claimed in claim 1 wherein said locking arm comprises a solid element having a groove formed therein such that said slidable engaging element is positioned in said groove when cooperating with said locking arm to prevent withdrawal thereof from said recess.

5. A door lock as claimed in claim 4 wherein said locking arm is connected to the door frame in a manner permitting alteration of its position thereon.

6. A door lock for locking a door within a door frame, said lock including a locking arm of predetermined form mounted to and extending outwardly from the door frame, said lock being mounted to the door and having operating means defining an aperture which said locking arm enters when the door is closed, said operating means being movable by said locking arm as it fully enters said aperture; said operating means further including means for constricting said aperture, in the form of a slidable locking element, to prevent withdrawal of said locking arm therefrom one said locking arm has entered said aperture and locking means for locking said constricting means to prevent movement thereof; and unlocking means capable of releasing said constricting means to allow the withdrawal of said locking arm from said aperture; and said operating means further including means defining a recess, and means for resiliently biasing said slidable locking element into said recess defining means, said locking means includes means comprising a rotatable cam element and means to resiliently bias said rotatable cam element to a first position locking said slidable locking element in an extended position into said recess for preventing withdrawal of said locking arm, said rotatable cam element being rotatable to a second position in which said slidable locking element will be moved to a lowered position which allow s movement of said locking arm relative to said aperture, and a pivotable lever arm located to extend into the recess to hold said rotatable cam element in said second position and being pivoted by the locking arm entering said aperture to a position and being held in that position by said locking arm whereby said rotatable cam element can move to the first position, said unlocking means including means for moving said rotatable cam element to said second position.

7. A door lock as claimed in claim 6 wherein said locking arm is connected to the door frame in manner that permits alteration of said locking arm position thereon.

8. A door lock as claimed in claim 6 wherein said locking arm comprises a solid element having a groove formed therein such that said locking element will extend into said groove when said rotatable cam element is in said first position following complete entry of said locking arm into said aperture.

9. A door lock as claimed in claim 6 wherein said unlocking means comprises a solenoid operatively connected to said rotatable cam element for moving said operating means to allow withdrawal of said locking arm from said aperture when the solenoid is actuated.

10. A door lock as claimed in claim 6 wherein said unlocking means includes a pivotable door handle having a pivot arm connected thereto and operatively associated with said operating means to permit the withdrawal of the locking arm from the aperture upon pivoting of said door handle.

11. A door lock as claimed in claim 6 wherein said unlocking means includes a key cylinder movable by the correct key to a position for moving said operating means to allow withdrawal of the locking arm from the aperture.

12. A door lock as claimed in claim 11 wherein said unlocking means comprises a solenoid operatively associated with said operating means to allow withdrawal of said locking arm from said aperture when said solenoid is actuated.

13. A door lock as claimed in claim 11 wherein said unlocking means includes a pivotable door handle having a pivot arm connected thereto and operatively associated with said operating means to permit the withdrawal of said locking arm from said aperture upon pivoting of said door handle.

14. A door lock as claimed in claim 11 wherein said unlocking means includes a key cylinder movable by the correct key to a position for moving said operating means to allow withdrawal of said locking arm from said aperture.

* * * * *